US008214950B2

(12) United States Patent
Topaz et al.

(10) Patent No.: US 8,214,950 B2
(45) Date of Patent: Jul. 10, 2012

(54) CARRYING SLING FOR A PERSON

(76) Inventors: Peter A. Topaz, Slappoose, OR (US); Carol J. Topaz, Slappoose, OR (US); Stephen R. Topaz, St. Helens, OR (US)

( * ) Notice: Subject to any disclaimer, the term of this patent is extended or adjusted under 35 U.S.C. 154(b) by 18 days.

(21) Appl. No.: 12/804,467

(22) Filed: Jul. 21, 2010

(65) Prior Publication Data

US 2012/0018466 A1 Jan. 26, 2012

(51) Int. Cl.
*A61G 1/01* (2006.01)

(52) U.S. Cl. ..... 5/625; 5/81.1 T; 5/655; 5/628

(58) Field of Classification Search ..... 5/81.1 T, 5/625–629, 655; 128/870; 182/3
See application file for complete search history.

(56) References Cited

U.S. PATENT DOCUMENTS 2,788,530 A * 4/1957 Ferguson ..... 5/628
3,701,395 A * 10/1972 Theobald ..... 182/3
4,127,120 A * 11/1978 Applegate ..... 5/628
4,283,068 A * 8/1981 Keyser ..... 280/19
4,945,583 A * 8/1990 Schnitzler ..... 5/628
5,787,529 A * 8/1998 Landes ..... 5/628
6,035,440 A * 3/2000 Woodyard ..... 2/102
7,360,543 B1 * 4/2008 Coleman et al. ..... 128/870
7,624,458 B2 * 12/2009 Felling ..... 5/81.1 T
7,708,019 B2 * 5/2010 Kendrick ..... 128/870
2004/0088794 A1 * 5/2004 Calkin ..... 5/628
2006/0137097 A1 * 6/2006 Frost ..... 5/628

* cited by examiner

*Primary Examiner* — William Kelleher
(74) *Attorney, Agent, or Firm* — Ingrid McTaggart

(57) ABSTRACT

The present invention provides a carrying sling for a person including a flexible sheet, and an elongate flexible member secured in first, second, third and fourth locations to the sheet, the first and second locations defining a first leg loop there between, the first and third locations defining a second leg loop there between, the fourth location defining a torso support, the second and fourth locations defining a first handle there between for lifting the sheet, and the third and fourth locations defining a second handle there between for lifting the sheet.

20 Claims, 2 Drawing Sheets

CARRYING SLING FOR A PERSON

BACKGROUND OF THE INVENTION

Children undergoing medical procedures and medically fragile children often must be physically moved, such as into and out of car seats, high chairs, bathtubs and cribs. In some cases, such as after cardiac surgery, a child must not be picked up underneath their arms, for example, the child must not be lifted by their armpits. In such cases, the child is lifted by placing ones arms underneath the child's legs and torso. Placement of the lifters arms under the child's legs and torso may be very difficult to accomplish when the child is positioned in a car seat, a high chair, a bathtub or a crib. Accordingly, it is desirable to provide means to safely and efficiently lift and carry such medially fragile children.

SUMMARY OF THE INVENTION

The present invention provides a carrying sling for a person, such as a child, that allows the safe and efficient lifting and moving of a child undergoing a medical procedure or a medically fragile child. The invention comprises a sling including a handle adjacent a head support area of the sling and a handle adjacent a leg support area of the sling. In one embodiment the handle adjacent the leg support area of the sling comprises adjustable webbing that allows lifting of the sling and simultaneously tightens two leg loops of the webbing to secure the child in the sling as the webbing is gripped by the lifter.

DETAILED DESCRIPTION OF THE DRAWINGS

Figure 1:
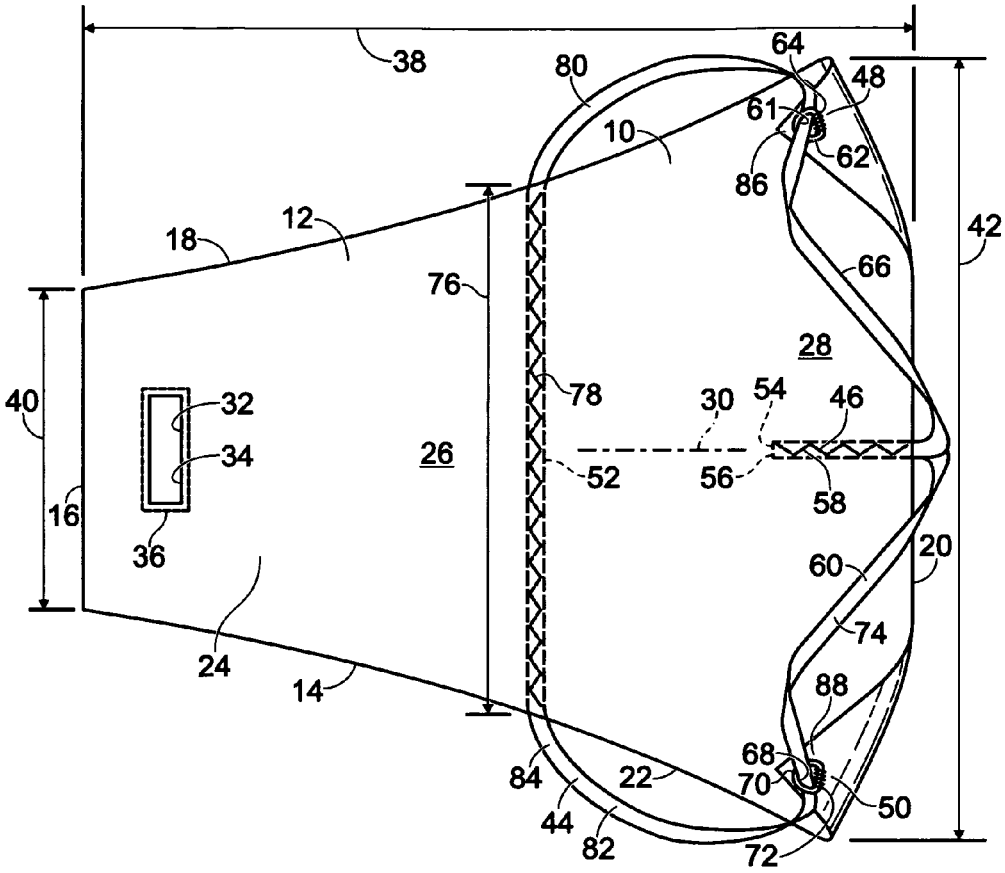
FIG. 1 is a top view showing one embodiment of a carrying sling for a person while the sling is not in use.

FIG. 1 is a top view showing one embodiment of a carrying sling 10 for a person, such as a child, while the sling is not in use. Sling 10 includes a sheet 12 of flexible material, such as cloth. Sheet 12 may be cut in a trapezoid shape having a perimeter 14. Perimeter 14 may include a top edge 16, a first side edge 18, a bottom edge 20 and a second side edge 22. Each of edges 16-22 may include a turned over portion of cloth that may be stitched around the perimeter 14 of sheet 12 to add strength to the sheet 12 and to prevent fraying of the material of sheet 12.

Sheet 12 may include a top region 24, also referred to as a head support region, a central region 26, also referred to as a torso support region, and a bottom region 28, also referred to as a leg support region of sheet 12. Top region 24 may comprise the narrower portion of the trapezoid shape of sheet 12, and bottom region 28 may comprise the larger portion of the trapezoid shape of sheet 12. Sheet 12 may include an elongate axis 30 that extends through top region 24, central region 26 and bottom region 28.

Sheet 12 may include a handle 32 in head support region 24 for lifting the sling 10. Handle 32, in the embodiment shown, comprises an aperture 34 cut through sheet 12. The sheet material around aperture 34 may be sewn with stitching 36 to reinforce a strength of aperture 34 for use as handle 32.

Sheet 12 generally is sized to receive a child thereon for lifting support of the child. Sheet 12 may be sized so that a child's head is received on head support region 24, the child's torso is received on torso support region 26, and at least the upper portion of the child's leg's are received on leg support region 28. Accordingly, in one embodiment, sheet 12 may have a length 38 of approximately 28 inches (71 centimeters), as measured along elongate axis 30, a width 40 of approximately 10 and a half inches (26 centimeters) as measured along top edge 16, and width 42 of approximately 24 inches (61 centimeters) as measured along bottom edge 20. In other embodiments, other sizes may be utilized.

Still referring to FIG. 1, sling 10 further comprises an elongate flexible member 44, such as a length of nylon webbing. Flexible member 44 generally is secured to sheet 12 in first 46, second 48, third 50 and fourth 52, locations. In the embodiment shown, a first end 54 and a second end 56 of flexible member 44 are both secured at first location 46 on sheet 12 by a fastener 58, such as stitching. In other embodiments fastener 58 may comprise staples, glue, releasable snaps, press-studs, or the like. Fastening of first and second ends 54 and 56 at first location 46 on sheet 12 defines a loop 60 of flexible member 44 secured to sheet 12. Flexible member 44, in the embodiment shown, defines a total length of approximately 66 inches (168 centimeters).

In the embodiment shown, first location 46 on sheet 12 defines a crotch region of sheet 12, meaning that when a child is secured within sling 10, flexible member 44 secured at first location 46 is positioned between the legs of the child. Flexible member 44 secured at second location 48 on sheet 12 is positioned along first side edge 18 of sheet 12, outwardly from first location 46 and elongate axis 30. Flexible member 44 may be secured at sheet 12 in second location 48 through an aperture 61. Aperture 61, in the embodiment shown, extends through a ring 62 secured to sheet 12 by a fastener, such as stitching 64, at second location 48. In another embodiment, aperture 61 may define an aperture extending directly through sheet 12. The portion of flexible member 44 that extends between aperture 61 and first securement location 46 defines a first leg loop 66 of sling 10, i.e., a leg loop 66 for receiving the first leg of a child there through.

Securement of member 44 through an aperture 61 allows flexible member 44 to move freely within aperture 61 so that when sling 10 is lifted, the weight of a child positioned on sheet 12 will move flexible member 44 within aperture 61 until aperture 61 on sheet 12 is positioned adjacent the child's leg and generally adjacent to first location 46. In other words, lifting of sheet 12 by member 44, with a child positioned on sheet 12, will result in tightening of first leg loop 66 around a child's leg positioned between bottom edge 20 and flexible member 44 in loop 66, thereby securing the child within sling 10 as the sling is lifted.

Similarly, flexible member 44 secured at third location 50 on sheet 12 is positioned along second side edge 22 of sheet 12, outwardly from first location 46 and elongate axis 30. Flexible member 44 may be secured at sheet 12 in third location 50 through an aperture 68. Aperture 68, in the embodiment shown, extends through a ring 70 secured to sheet 12 by a fastener, such as stitching 72, at third location 50. In another embodiment, aperture 68 may define an aperture extending directly through sheet 12. The portion of flexible member 44 that extends between aperture 68 and first securement location 46 defines a second leg loop 74 of sling 10, i.e., a leg loop 74 for receiving the second leg of a child there through.

Securement of member 44 through an aperture 68 allows flexible member 44 to move freely within aperture 68 so that when sling 10 is lifted, the weight of a child positioned on sheet 12 will move flexible member 44 within aperture 68 until aperture 68 on sheet 12 is positioned adjacent the child's leg and generally adjacent to first location 46. In other words, lifting of sheet 12 with a child positioned thereon will result in tightening of second leg loop 74 around a child's leg positioned between bottom edge 20 and flexible member 44, thereby securing the child within sling 10 as the sling is lifted.

Flexible member 44 is further secured to sheet 12 in fourth location 52, that may extend across a width 76 of sheet 12 in central region 26. Member 44 may be secured completely across the width 76 of central region 26 of sheet 12, such as by a fastener 78, which in the embodiment shown, is one or more lines of stitching. The length of flexible member 44 that extends between fastener 78 and second securement location 48 defines a first half 80 of a handle of member 44 and the length of flexible member 44 that extends between fastener 78 and third securement location 50 defines a second half 82 of a handle of member 44. During lifting of sheet 12, both first and second half handles 80 and 82 of flexible member 44 may together be gripped and lifted to collectively define a handle 84 of sling 10 so that sling 10 may include first handle 32 and second handle 84. During such lifting of sling 10 with a child positioned therein, flexible member 44 at fourth location 52 supports a torso of the child, flexible member 44 at first, second and third locations 46, 48 and 50, supports the legs of the child, and the material of sheet 12 positioned between these two support regions, wherein the member 44 is secured to the sheet 12, supports the child's body positioned between the child's torso and legs.

In an embodiment wherein fourth securement location 52 is positioned adjacent a head region of sheet 12, first half handle 80 and second half handle 82 of member 44, and sheet 12 positioned there between, will completely support a child positioned within sling 10. In the embodiment shown, wherein fourth securement location 52 is positioned in a torso region of sheet 12, first half handle 80 and second half handle 82 of member 44 together comprise a handle 84 that supports a lower region of the child and handle 32, positioned near top edge 16 of sheet 12, is utilized to support an upper region of the child during lifting of the child in sling 10.

In the embodiment shown, a total length of member 44 is such that in the nominal unused position, member 44 extending through rings 62 and 70 will pull the corresponding corners 86 and 88 of sheet 12 inwardly toward elongate axis 30.

In another embodiment, flexible member 44 may not be secured completely along a width of sheet 12 in central region 26 but instead may include an end of member 44 secured to each of sides edges 18 and 22 of sheet 12 in central region 26.

Figure 2:
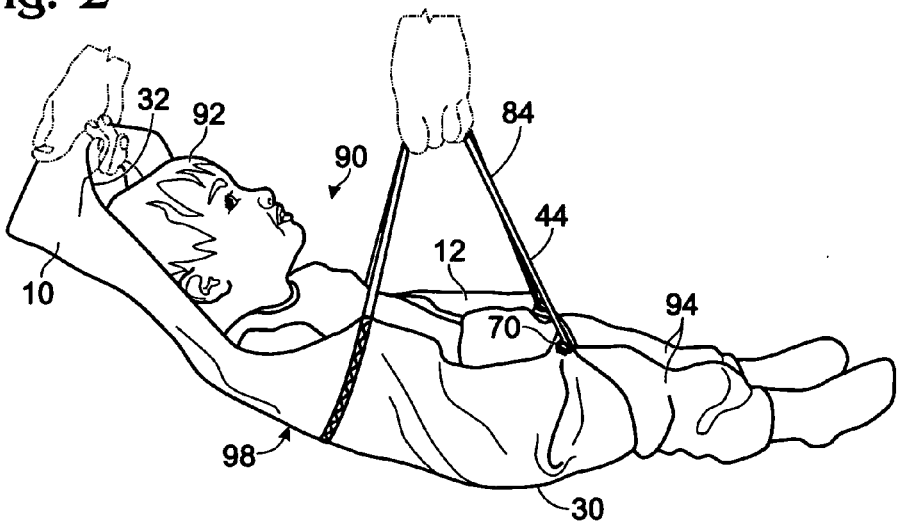
FIG. 2 is a side view of one embodiment of a carrying sling for a person while the sling is in use carrying a child.

FIG. 2 is a side view of one embodiment of a carrying sling 10 for a person while the sling is in use carrying a child. In this embodiment, the weight of a child 90 held within sling 10, and the lifting force of a lifter holding handle 84 of webbing 44, causes rings 62 and 70 to slide along webbing 44, each to a position adjacent the child's legs and closer to first securement location 46 such that leg loops 66 and 74 are tightened around the child's legs. In this lifting configuration webbing 44 at first securement location 46 is positioned between the child's legs, thereby preventing the child 90 from slipping out the sling at bottom edge 20. Additionally, the weight of a child 90 held within sling 10, and the lifting force of a lifter holding handle 84 of webbing 44, causes sheet 12 to move downwardly along elongate axis 30, and causes the side regions of sheet 12 adjacent side edges 18 and 22 to wrap around the child 90, thereby preventing the child 90 from slipping out the sling along either of side edges 18 or 22. Furthermore, the weight of a child 90 held within sling 10, and the lifting force of a lifter holding handle 32 of sheet 12, causes child 90 to be supported by the sheet 12, and wherein the lifter's grip on handle 32 prevents the child 90 from slipping out the sling along top edge 16 of sheet 12.

When each of the lifter's hands are positioned at a similar height above a ground surface, due to the length of webbing 44 of second handle 84, child 90 will be positioned with their head 92 slightly above their legs 94, which will provide a comfortable position for the child and will ensure the child is positioned in sling 10 such that each of the child's legs 94 is received in one of leg loops 66 and 74, thereby preventing the child from slipping from the sling. In other words, sling 10 is said to wrap around the sides of a child 90 held within the sling 10 so as to secure the child 90 therein.

When not in use, sling 10 is easily folded and stored. Moreover, sling 10 is easily washed and may be manufactured in any size as may be desired. The sling may also be manufactured of a plastic coated or other water resistant/repellant material so as to facilitate cleaning of the sling. The sling of the present invention, therefore, provides a secure and comfortable carrying sling which allows the lifter to efficiently and safely lift and carry a child without holding the child under the child's armpits. Moreover, the thin flexible nature of sling 10 allows the child to remain in the sling 10, when handles 32 and 84 are not gripped, so that the sling need not be removed when the child is placed in a high chair, a car seat or a bathtub, for example. Accordingly, the child may be easily lifted from the high chair, car seat or bathtub, without requiring repositioning of sling 10 underneath the child after such activities.

Figure 3:
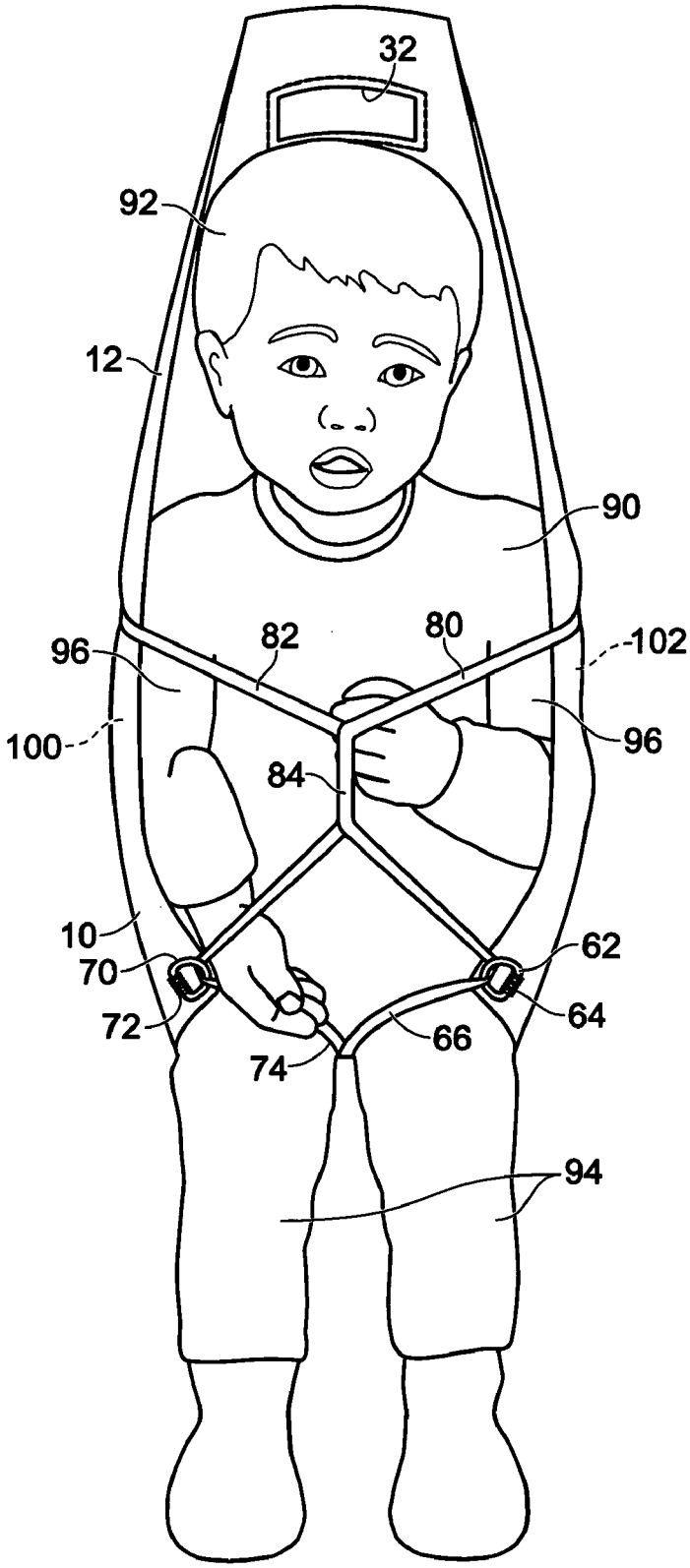
FIG. 3 is a top view of one embodiment of a carrying sling for a person while the sling is in use carrying a child.

FIG. 3 is a top view of one embodiment of a carrying sling 10 for a person while the sling is in use carrying a child 90. In this top view leg loops 66 and 74 are each shown snuggly fitted around a corresponding one of child's legs 94. Webbing 44 secured at first location 46 is also shown positioned between the child's legs 94, so as to prevent the child from slipping past bottom edge 20 of sling 10. Webbing 44 secured to sheet 12 in central region 26 is shown extending upwardly and around the child's arms 96 such that the child 90 is supportably wrapped by sling 10 around the child's back 98 and sides 100 and 102. Handle 32 is shown positioned above the child's head 92 for ease of gripping of handle 32 by a lifter.

Other variations and modifications of the concepts described herein may be utilized and fall within the scope of the claims below.

We claim:

1. A carrying sling for a person, comprising:

a flexible sheet including a first end region, a second end region and a central region positioned there between;

a first handle positioned in said first end region;

a first continuous elongate flexible member immovably secured at a first end in said central region of said sheet, immovably secured at a second end in said second end region of said sheet, and movably secured between said first and said second ends of said flexible member by a first fastener in said second end region of said sheet;

a second continuous elongate flexible member immovably secured at a first end in said central region of said sheet, immovably secured at a second end in said second end region of said sheet, and movably secured between said first and said second ends of said flexible member by a second fastener in said second end region of said sheet;

wherein a length of said first elongate flexible member between said first end of said member and said first fastener defines a first handle loop and a length of said first elongate flexible member between said first fastener and said second end of said member defines a first leg loop;

wherein a length of said second elongate flexible member between said first end of said member and said second fastener defines a second handle loop and a length of said first elongate flexible member between said second fastener and said second end of said member defines a second leg loop;

wherein said first continuous elongate flexible member moves freely through said first fastener such that when said first handle loop is pulled said first leg loop is tightened by a corresponding amount; and wherein said second continuous elongate flexible member moves freely through said second fastener such that when said second handle loop is pulled said second leg loop is tightened by a corresponding amount.

2. The sling of claim 1 wherein said flexible sheet defines an elongate axis that extends through said first end region, said second end region and said central region, and wherein said second end of said first and said second elongate flexible members are secured on said elongate axis in said second end region, said first end of said first elongate flexible member is secured at a first edge position along a first side edge of said flexible member, outwardly from said elongate axis, and said first end of said second elongate flexible member is secured at a second edge position along a second side edge of said flexible member, outwardly from said elongate axis, said first and second side edges positioned opposite one another across said elongate axis.

3. The sling of claim 1 wherein said first and second fasteners each comprise a ring secured to said sheet, wherein each of said elongate flexible members moves freely through a corresponding one of said rings.

4. The sling of claim 1 wherein said first and second continuous elongate flexible members are each a portion of one single, continuous length of elongate flexible member, and wherein said first and said second handle loops of said one single elongate flexible member together define a second handle of said sling.

5. The sling of claim 1 wherein said first handle comprises an aperture that extends through said sheet.

6. The sling of claim 1 wherein said sheet defines a trapezoid shaped perimeter when said sheet is positioned in a flat, unfolded configuration, and wherein said first end region defines a narrowest end of said trapezoid and wherein said second end region defines a largest end of said trapezoid.

7. The sling of claim 1 wherein said sheet is manufactured of cloth and wherein said elongate flexible members are manufactured of nylon webbing.

8. The sling of claim 1 wherein said second end of said first member and said second end of said second member are both secured between said first and second leg loops.

9. The sling of claim 4 wherein said flexible sheet defines a person receiving cavity when said flexible sheet is lifted by said first and said second handle loops, said person receiving cavity enclosed on opposing first and second side regions by said flexible sheet.

10. A method of lifting a person, comprising:

placing a sheet in an open position, said sheet including an elongate, continuous flexible member secured thereto in first, second, third and fourth securement positions on said sheet, said first securement position positioned in a crotch region of said sheet, said second securement position positioned outwardly of said crotch region so as to define a first leg loop between said first and second securement positions, said third securement position positioned outwardly of said crotch region, opposite said crotch region from said second securement position, so as to define a second leg loop between said first and third securement positions, and said fourth securement position positioned in a torso region of said sheet, wherein said elongate flexible member is secured to said sheet at said second position by a first fastener through which said flexible member moves freely and said elongate flexible member is secured to said sheet at said third position by a second fastener through which said flexible member moves freely;

placing a person on said sheet;

positioning a first leg of said person through said first leg loop;

positioning a second leg of said person through said second leg loop; and lifting said person by lifting said sheet by said elongate flexible member along a first length of said elongate flexible member between said second and said fourth securement positions and along a second length of said elongate flexible member between said third and said fourth securement positions.

11. The method of claim 10 further comprising lifting a person by lifting said sheet by gripping a handle in a head support region of said sheet.

12. The method of claim 10 wherein said second securement position includes securement of said elongate flexible member to said sheet by a first aperture through said first fastener, wherein said third securement position includes securement of said elongate flexible member to said sheet by a second aperture through said second fastener, and wherein said elongate flexible member moves through said first and second apertures as said sheet is lifted.

13. The method of claim 12 wherein when said sheet is lifted by said elongate flexible member, said flexible member moves through said first and second apertures so as to tighten said first and second leg loops to secure a person in said sheet.

14. The method of claim 13 wherein when said sheet is lifted by said elongate flexible member, said flexible member wraps said sheet around a person positioned thereon so as to secure the person in said sheet.

15. The method of claim 14 wherein when said sheet is lifted by said elongate flexible member, a weight of a person in said sheet pulls said sheet downwardly and moves each of said first and second apertures along said elongate flexible member into a position adjacent said first securement position in said crotch region of said sheet so as to tighten said first and second leg loops around a first and second leg, respectively, of the person secured in the sheet.

16. A carrying sling for a person, comprising:

a flexible sheet; and an elongate, continuous flexible member secured in first, second, third and fourth locations to said sheet, said first and second locations defining a first leg loop there between, said first and third locations defining a second leg loop there between, said fourth location defining a torso support, said second and fourth locations defining a first handle loop there between for lifting said sheet, and said third and fourth locations defining a second handle loop there between for lifting said sheet, whereby said elongate flexible member is secured to said sheet at said second location by a first fastener through which said flexible member moves freely, and whereby said elongate flexible member is secured to said sheet at said third location by a second fastener through which said flexible member moves freely.

17. The sling of claim 16 wherein said first leg loop and said second leg loop are each positioned in a leg support region of said sheet, said sling further comprising a third handle positioned on said sheet in a head support region of said sheet, distal from said leg support region.

18. The sling of claim 17 wherein said third handle comprises an aperture extending through said sheet.

19. The sling of claim 16 wherein said elongate, continuous flexible member is secured at said second location through a first aperture of said first fastener that allows movement of said flexible member there through such that as said first handle is pulled said first leg loop is tightened, and wherein said elongate flexible member is secured at said third location through a second aperture of said second fastener that allows movement of said flexible member there through such that as said second handle is pulled said second leg loop is tightened.

20. The sling of claim 19 wherein said first and said second apertures are each chosen from one of an aperture extending through said sheet and an aperture through a ring secured to said sheet, and wherein in said first and said fourth locations said flexible member is fixedly secured to said sheet.

* * * * *